US006881068B2

(12) United States Patent
Thornley et al.

(10) Patent No.: US 6,881,068 B2
(45) Date of Patent: Apr. 19, 2005

(54) GOLF TRAINING APPARATUS AND METHOD

(76) Inventors: Paul Richard Thornley, 18 Godstone Mount Dounscourt Road, Purley CR8 1BA (GB); Brian Stuart Dempsey, 63 Grove Avenue, Twickenham TW1 4HX (GB)

( * ) Notice: Subject to any disclaimer, the term of this patent is extended or adjusted under 35 U.S.C. 154(b) by 0 days.

(21) Appl. No.: 10/344,791

(22) PCT Filed: Aug. 15, 2001

(86) PCT No.: PCT/GB01/03659

§ 371 (c)(1),
(2), (4) Date: Feb. 14, 2003

(87) PCT Pub. No.: WO02/13918

PCT Pub. Date: Feb. 21, 2002

(65) Prior Publication Data

US 2003/0175668 A1 Sep. 18, 2003

(30) Foreign Application Priority Data

Aug. 15, 2000 (GB) ..... 0020102

(51) Int. Cl.[7] ..... A63B 69/36

(52) U.S. Cl. ..... 434/252; 473/195; 473/196; 473/197; 473/278; 473/279; 273/400; 273/298; 273/401

(58) Field of Search ..... 434/252; 473/195, 473/197, 196, 194, 256, 268, 279; 273/400, 398, 401

(56) References Cited

U.S. PATENT DOCUMENTS 920,907 A * 5/1909 Bolton ..... 473/197
1,629,907 A * 5/1927 Dwyer ..... 473/190
2,455,185 A * 11/1948 May ..... 473/195
3,580,578 A * 5/1971 McCarthy ..... 473/471
3,717,349 A * 2/1973 Bohnen ..... 473/262
3,986,719 A * 10/1976 Lee ..... 473/197
4,254,952 A * 3/1981 Playter, Jr. ..... 473/456
4,303,245 A * 12/1981 Brockett ..... 473/190
4,395,042 A * 7/1983 Boswell ..... 473/195
4,432,552 A * 2/1984 Saverino ..... 473/256
4,750,744 A * 6/1988 Michalec ..... 473/195
5,042,813 A * 8/1991 Huang ..... 473/153
5,876,291 A * 3/1999 Dubose ..... 473/197

* cited by examiner

*Primary Examiner*—Derris H. Banks
*Assistant Examiner*—Dmitry Suhol
(74) *Attorney, Agent, or Firm*—Priest & Goldstein, PLLC

(57) ABSTRACT

Techniques for training and correcting a golf swing are described. A golfer places a ball at a teeing point on a teeing surface which is tiltably adjustable about a horizontal tilt axis. A catch device is aligned with a target direction passing through the teeing point and extending perpendicularly to the tilt axis. The golfer aims along the target direction and executes a golf swing to strike the ball from the teeing point. The actual direction of travel of the struck ball is determined. An azimuth difference is determined between the target direction and the actual direction of travel of the struck ball. The tilt angle of the teeing surface is varied about the tilt axis based upon the azimuth difference between the target direction and the actual direction of travel of the struck ball.

6 Claims, 7 Drawing Sheets

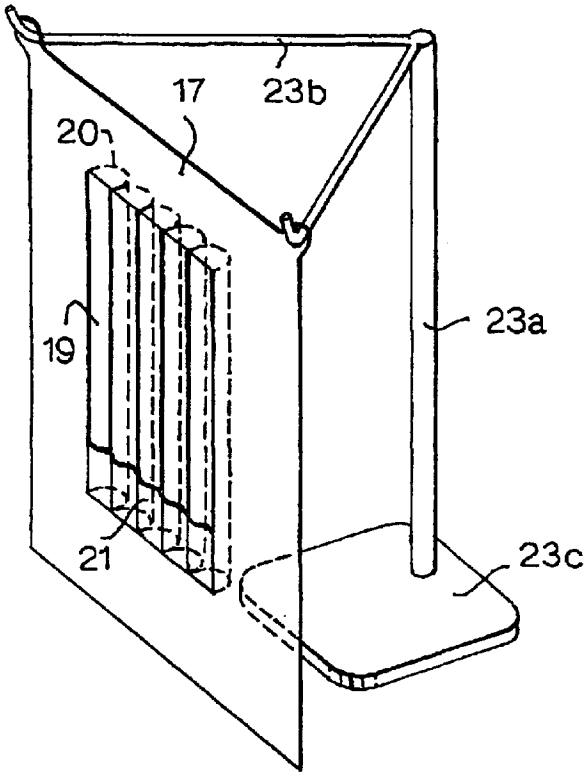
Fig. 1.
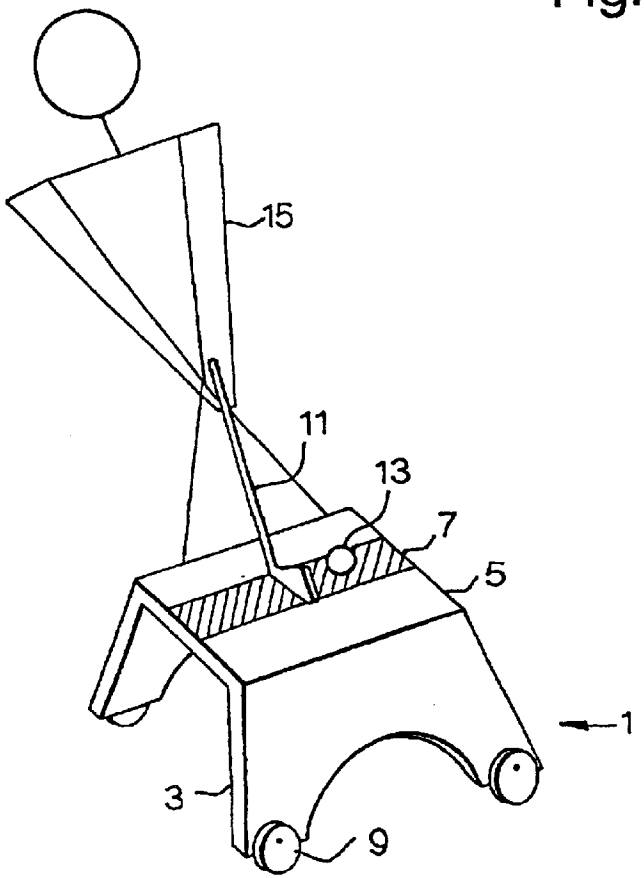

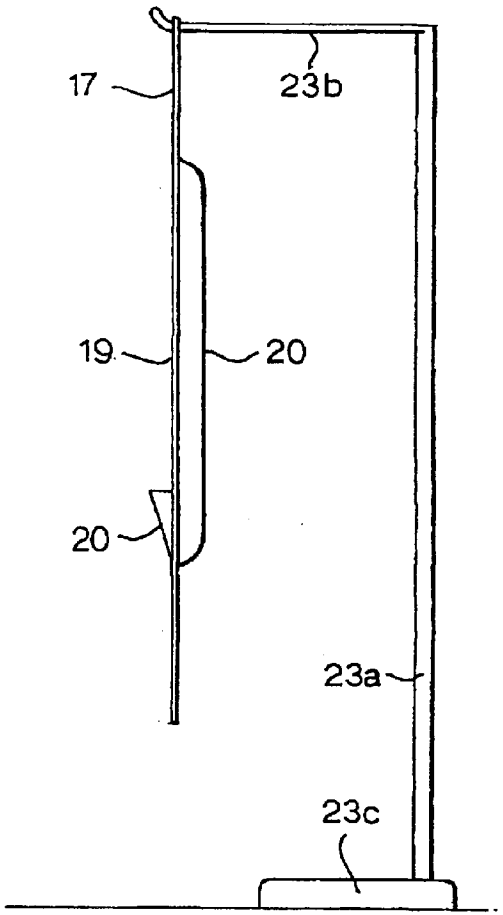
Fig.4.
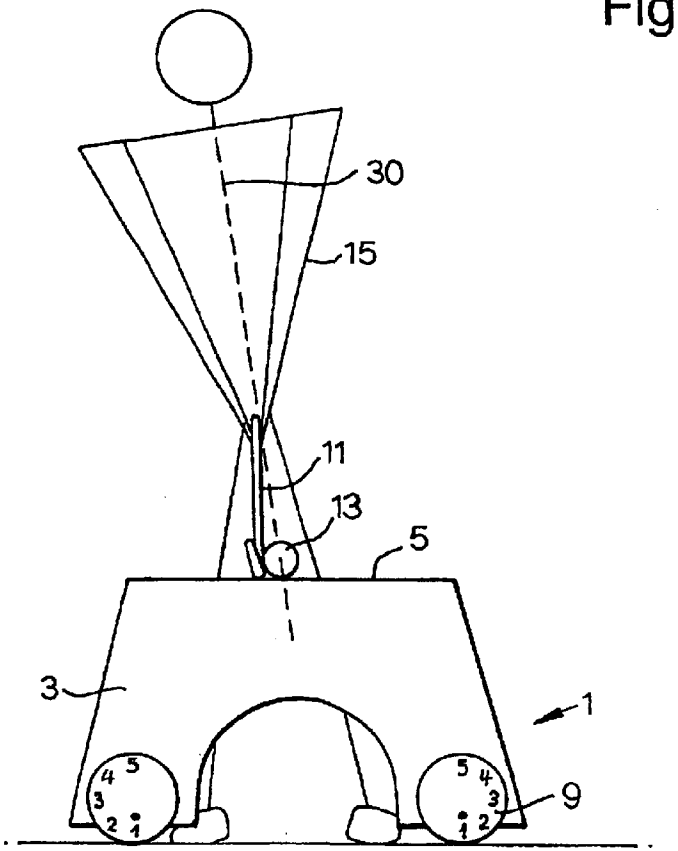

GOLF TRAINING APPARATUS AND METHOD

This invention relates to a golf training apparatus and method, and particularly but not exclusively concerns a means for indicating whether a golf practice shot has been hooked, or sliced.

It is known from U.S. Pat. No. 4,432,552 to provide legs which are adjustable in height to support the elevated table at different angles relative to the horizontal. This adjustment is intended to allow different terrains to be simulated (e.g. a downhill lie of the ball, an uphill lie of the ball, and side slopes to the left or right).

It is also known from U.S. Pat. No. 4,432,552 (Saverino) to provide golf practice apparatus consisting of an elevated table or platform having an artificial grass surface and supported on a plurality of legs, each of which is adjustable in height and a golf club of reduced length for use in combination with the table. This shortened club allows full swing practices to be made within the confines of a normal room, and the raised table enables the golfer to hit a ball with the short club while maintaining a correct stance. However, although such an apparatus allows a golfer to execute a full golf swing, the apparatus does not provide an indication as to whether the swing is being performed correctly, in that no means is provided for determining a horizontal azimuth direction of the golf ball when the ball is struck.

It is an object of the present invention to provide a golf training apparatus which allows the golfer to determine the horizontal azimuth direction of the golf ball and thus correct his swing to eliminate hooked shots or sliced shots from the majority of the golfer's shots, thus allowing the golfer to practice so that the number of shots struck straight increases.

It is an object of the present invention to provide a golf training method and apparatus which allows a golfer to correct his swing by altering the angle his spine makes relative to the horizontal at the moment of impact with the ball by adjusting the angle of a playing surface of a teeing apparatus.

According to a first aspect of the present invention, there is provided a golf training apparatus comprising:

- an adjustable playing surface defining a starting position for a golf ball; and
- a direction indicating means for indicating a horizontal azimuth direction of a ball struck from a starting position, comprising:
- means to define a vertical plane through which the ball is intended to pass, and
- means for determining a horizontal position of an intersection of a path taken by said ball with said vertical plane.

A second aspect provides a golf swing training method, wherein the azimuth direction of a struck ball is determined, and correction is made to elements of the golfer's swing on the basis of the determined direction. The elements may be to the golfer's stance or grip, or to his position relative to the ball prior to striking.

An advantage for a golfer using such a golf training apparatus and method 15 that he can determine the initial horizontal direction of the golf ball after it has been struck, thereby allowing him to correct his swing.

Embodiments of the invention will now be described by way of example and with reference to the accompanying drawings in which:

FIG. 1 is a schematic diagram showing the elements in a golf training apparatus;

FIG. 4 is a schematic diagram showing the teeing apparatus with a different angle of tilt;

Figure 2:
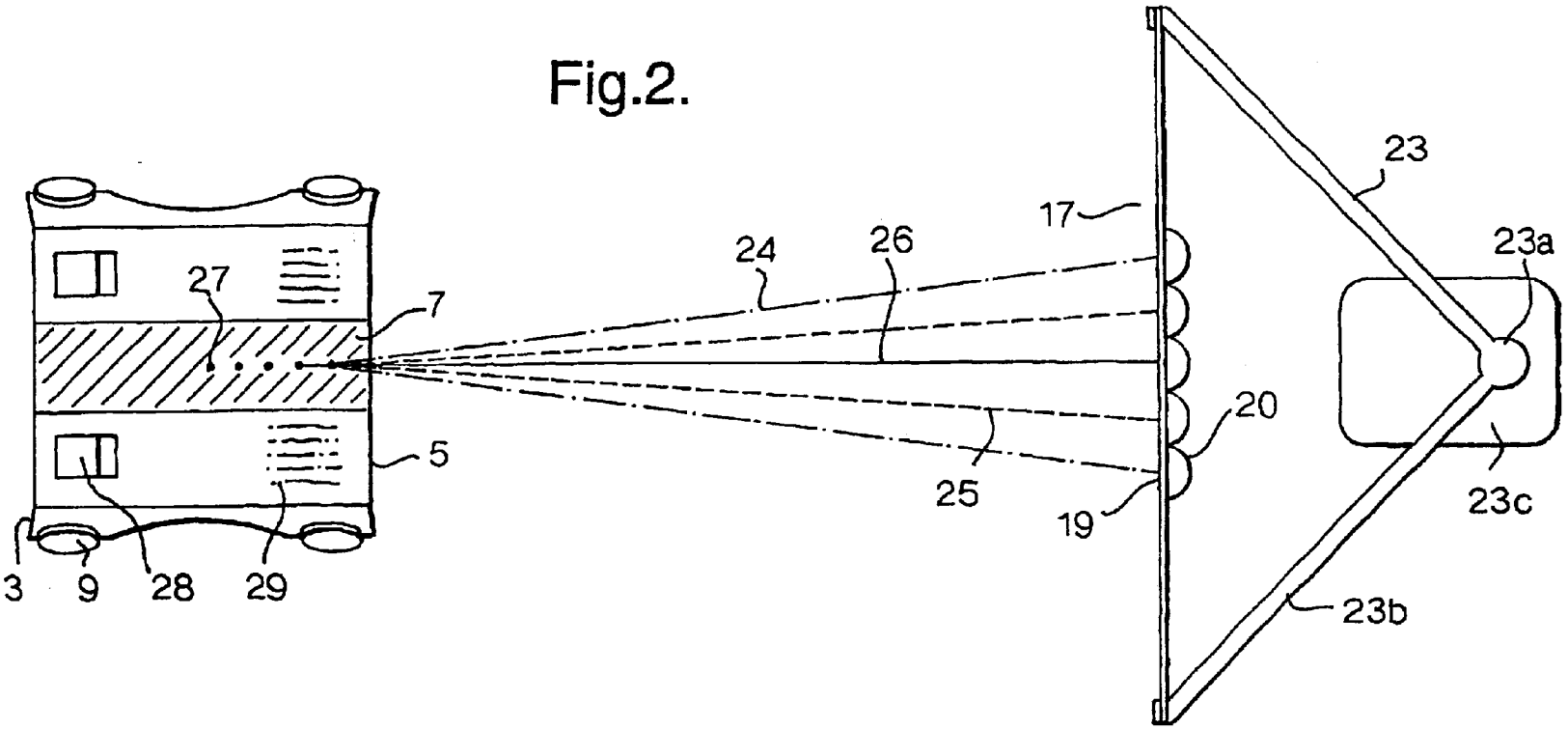
FIG. 2 is a plan view showing possible paths that a golf ball might take between a tee and a ball position detecting means.

FIG. 1 shows an apparatus for improving a golfer's golf swing in a first embodiment. The apparatus is designed so that it may be used indoors and comprises a number of elements, namely a teeing apparatus 1, a shortened golf club 11, a practice golf ball 13 (which is lighter than a standard golf ball) and catch net 17. The raised teeing apparatus 1 is provided with a flat teeing surface 5 supported by supporting legs 3 which at their ends are provided with means 9 for adjusting the angle of tilt of the raised teeing apparatus 1 (these will be described later in relation to FIG. 4). The teeing surface 5 of the raised teeing apparatus 1 is preferably provided with an artificial turf strip 7 which emulates the playing surface on a golf course. The golf club 11 is a standard golf club head with a shortened shaft. The provision of the shortened golf club 11 and the raised teeing apparatus 1 allows the use of the training apparatus indoors because the shortened golf club 11 allows the golfer 15 to practice using a full swing without risk of hitting a ceiling. The shortened golf club 11 in combination with the lighter than standard golf ball 13 also contribute to the reduction of the ball's energy when a shot is taken in comparison with a golf shot hit outdoors. This is because the golf club 11 imparts less initial impulse to the golf ball 13 and because the golf ball 13 is lighter, the momentum of the golf ball 13 is lower than that of a standard golf ball.

The catch net 17 is provided with a number of adjacent vertically extending openings 19 through one of which the ball 13 may pass when the golfer 15 plays a shot. Spaces behind each of said openings 19 are each enclosed by retaining means 20 for halting the progress of the ball 13 after it has passed through opening 19. The openings 19 are each provided at their respective lower end with a respective collecting pouch 21. Thus when a shot is played, the golf ball may pass through one of the openings 19 and is retained by the associated retaining means 20 which is formed of a netting material and this material stops the ball and subsequently the ball drops into the pouch 21 provided at the lower end of the opening 19.

The catch net 17 is suspended from support 23 which in this particular embodiment is a stand comprising an upright 23*a*, a pair of suspension arms 23*b* and a base 23*c*.

For use, the teeing apparatus 1 is placed approximately 1.5 metres from the catch net, with the teeing surface 5 aligned so that the ball 13 may be struck towards the catch net. The golfer's objective is to hit the ball through a particular one of the openings 19 of the catch net 17. Preferably, a central opening 19 of an array of adjacent openings is selected as the objective.

After the golfer 15 has taken his shot he can determine whether the ball was hit to the left, to the right or straight by observing the pouch 21 in which the ball 13 has come to rest. If the pouch 21 of the opening 19 aimed at contains the ball, then the shot was straight. If the pouch 21 of another opening 19 contains the ball, then the direction of the shot can be determined as being left or right, depending on the position of the pouch 21 containing the ball relative to the opening 19 aimed at. The deviation from the aiming point indicates the angle (i.e. the deviation of the club face from a direction perpendicular to the golfer) of the golf club head upon impact with the golf ball 13, thus allowing the golfer 15 to correct any defects in his swing action so that subsequent shots can be hit straight. Thus by using the apparatus the golfer 15 may be trained so that his golf swing improves.

The plan view of the golf training apparatus as shown in FIG. 2 illustrates in more detail the components provided on the playing surface 5 and also possible directions that the golf ball 13 may travel when struck (these horizontal vectors are illustrated by dashed lines 24 and 25 for shots hit to the left and right and a solid line 26 for a shot which is hit straight). The artificial turf strip 7 is provided with markings 27 which indicate points at which the ball may be placed when taking a shot. The teeing surface 5 is also provided with indicators 28 which allow the golfer to assess his entry swing (these will be explained in more detail in relation to FIG. 3). The playing surface 5 may also be provided with instructions 29 to remind the golfer 15 of certain steps to be taken before taking a shot (e.g. instructions to remind the golfer to check whether his grip, aim, stance and posture are correct before taking a shot).

Figure 3:
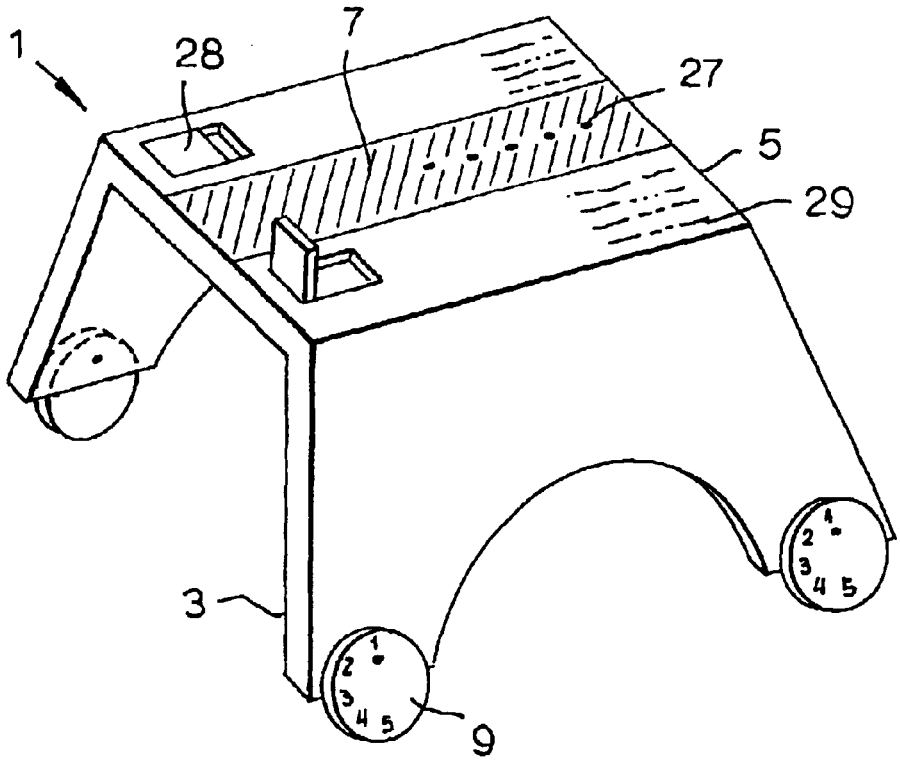
FIG. 3 is a schematic diagram showing a teeing apparatus in perspective view.

FIG. 3 shows in greater detail the raised teeing apparatus 1. The indicators 28 for indicating the line of entry swing are provided in recesses in the playing surface 5 and are hinged (not shown) at one end so that they may stand upright. When the golfer takes a swing, if his swing is correct then the indicator 28 will remain upright, conversely, if the golfer's entry swing is incorrect then the club will impact with the indicator 28 and move it to its down position. In this particular embodiment, two of these indicators 28 are provided, positioned symmetrically about a centre line of the playing surface 5 so that the raised tee 1 can be used by both left-handed and right-handed golfers.

In this figure, it can be seen that the adjusters 9 which allow the height/playing angle of the raised tee to be altered are rotatably fixed to the legs 3 of the raised teeing apparatus 1. These adjusters 9 are eccentrically mounted thus allowing a variety of different heights/angles of tilt to be achieved. These adjusters 9 are provided on the raised teeing apparatus 1, and allow the lateral as well as the longitudinal inclination of the apparatus to be altered so that a golfer 15 may train other aspects of his golf swing. In an alternative embodiment, adjusters may be provided only at one end of the raised tee, to provide longitudinal angular adjustment only. As an alternative to the eccentric adjusters, the teeing apparatus may be provided with adjustable telescopic legs.

If, when the playing surface is horizontal, a golfer's body position at the point of impact between the golf club 11 and golf ball 13 is such that he leans away from the direction of the shot (as seen in FIG. 4), hooking will result. To train the golfer out of this leaning habit, the adjusters 9 are used to tilt the teeing surface 5.

Figures 5A, 5B, 5C, 5D, 5E:
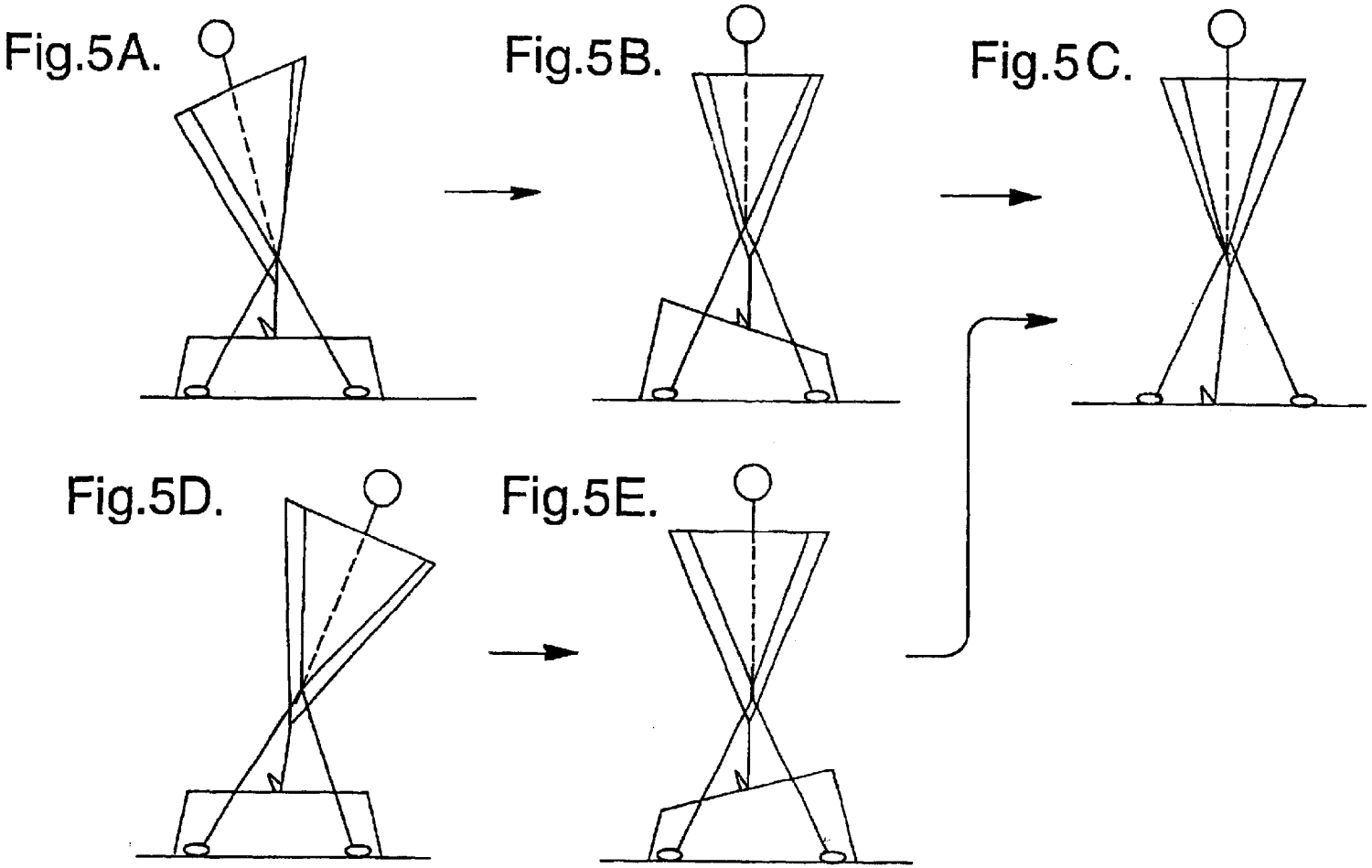
FIGS. 5A to 5E are schematic diagrams showing how the teeing apparatus may be used to correct a golfer's swing.

FIG. 5A represents schematically a golfer using the shortened club 11 and the teeing apparatus 3. As can be seen from this figure, at the point of impact between golf club 11 and golf ball 13, the golfer is leaning away from the direction of the shot (the same as in FIG. 4). As a result of this defect in his swing, the majority of shots taken by the golfer will be hook shots. FIG. 5B shows how the swing of the golfer in FIG. 5A can be corrected. The adjusters (not shown) of the teeing apparatus 3 are used to tilt the playing surface 5 so that it slopes downwards in the direction of the swing. This urges the golfer to alter his stance so as to position his spine perpendicular to the playing surface 5 at the point of impact between golf club 11 and golf ball 13 thus placing him in an upright position at this instant. By practising shots adopting this upright position, the golfer will become trained to take shots in an upright position. Thus when the teeing apparatus 3 is removed, the golfer continues to adopt the correct position at the moment of impact as shown in FIG. 5C.

FIG. 5D schematically represents a golfer who habitually leans in the same direction as the shot at the point of impact between golf club 11 and golf ball 13, thus causing the majority of shots taken to be sliced. As can be seen in FIG. 5E the adjusters (not shown) on the teeing apparatus 3 can be adjusted in this case to incline the playing surface so as to slope upwards in the direction of the swing. The golfer is urged to adjust his swing so as to adopt an upright position at the instant of impact, by bringing his spine perpendicular to the playing surface 5. By practising shots with the teeing apparatus 3 inclined in this way, the golfer's swing can be corrected as described previously so that when the teeing apparatus 3 is removed the golfer adopts a correct position at the point of impact between golf club 11 and golf ball 13, as shown in FIG. 5C. Both of these methods of tilting the playing surface 5 so that the golfer has to alter his swing when playing a shot allow the golfer to train his swing so that the number of shots hit to the left or right may be reduced and the number of straight shots may be increased.

Figure 6A:
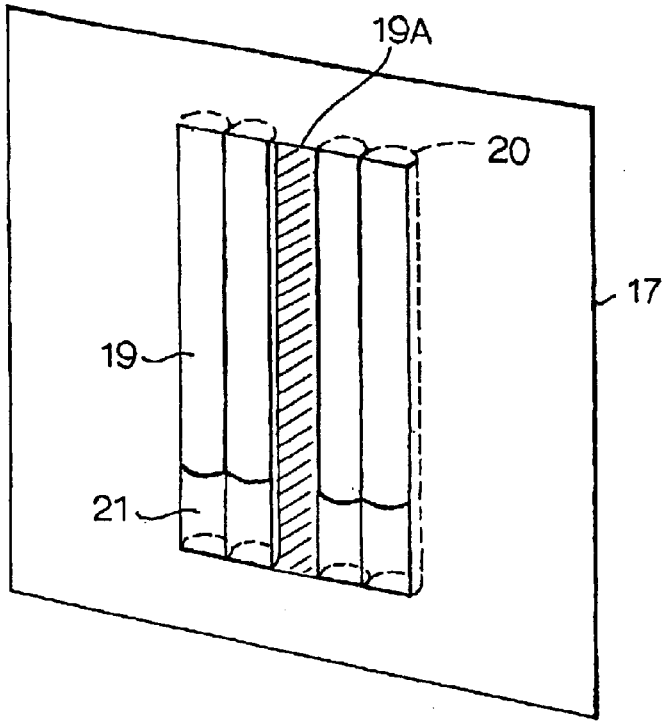
FIG. 6A is a schematic diagram showing a catch net in a further embodiment.

FIG. 6A illustrates the catch net 17 in another embodiment. The position detecting means 17 is essentially the same as that in the previous embodiment except that the retaining means 20 of the central opening 19 and pouch 21 have been removed. This apparatus may be used in conjunction with a full size golf club and standard weight ball on a golf driving range, for instance. The golfer aims the shot to pass through a central opening 19A. Shots hit to the left or right will then be caught by the retaining means 20 and straight shots are allowed to pass through the opening 19A.

Figure 6B:
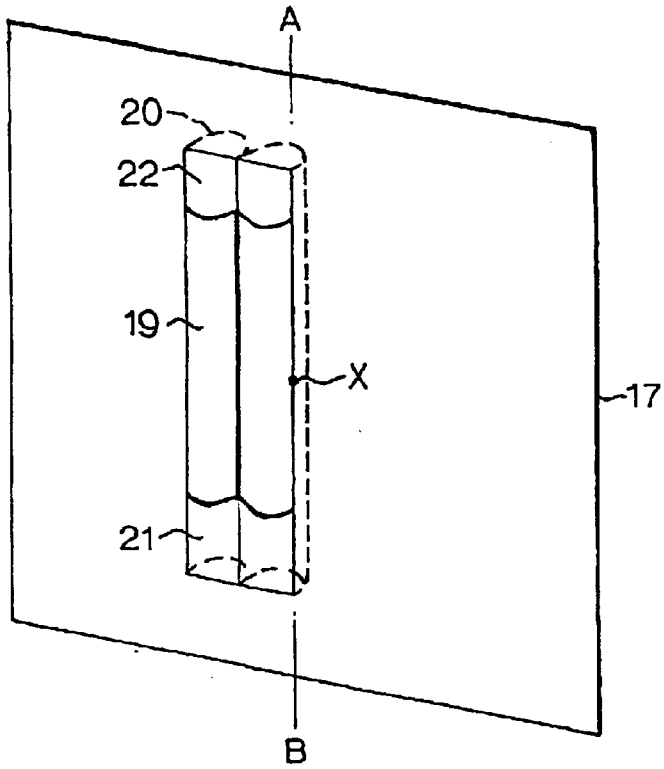
FIG. 6B is a schematic diagram showing a catch net in yet another embodiment.

FIG. 6B shows an asymmetric catch net 17 in a further embodiment. The catch net 17 is essentially the same as that in the first embodiment except that openings 19 and pouches 21 on one side of the vertical centre line of the catch net 17 have been removed and are replaced with plain netting. In the example shown, this would be used to correct a golfer's swing where the majority of shots are hit to the right. The position of the openings 19 to the left of the centre line of the ball detecting means 17 forces the golfer to play shots to the left. Training using the catch net of this embodiment will allow the golfer to correct his swing. Another feature which is different from that of the first embodiment is the provision of the additional pouches 22 at the opposite end of the opening 19 from the pouches 21. This then allows the catch net 17 to be rotated by 180° in its plane about a point X so that the openings 19 are on the right of the centre line. Thus training may be undertaken to correct a swing where the majority of shots are hit to the left. In an alternative, the slots may have pouches at one end only and the catch net rotated by 180° about axis AB and retaining means 20 turned "inside out" to provide an oppositely-handed asymmetric catch net.

The above advantage can also be achieved by using the catch net 17 of the first embodiment. This can be done by simply positioning the net 17 so that the central opening 19 of the net 17 does not correspond with the centre line of the raised teeing apparatus 1, and the net 17 thus is offset to either the left or right of the centre line of the raised teeing apparatus 1.

Figure 7:
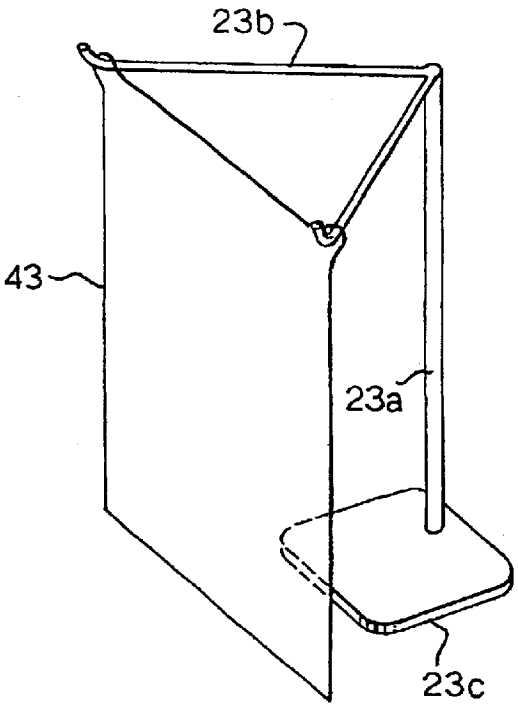
FIG. 7 is a schematic diagram showing a golf training apparatus in a further embodiment.
Figure 7:
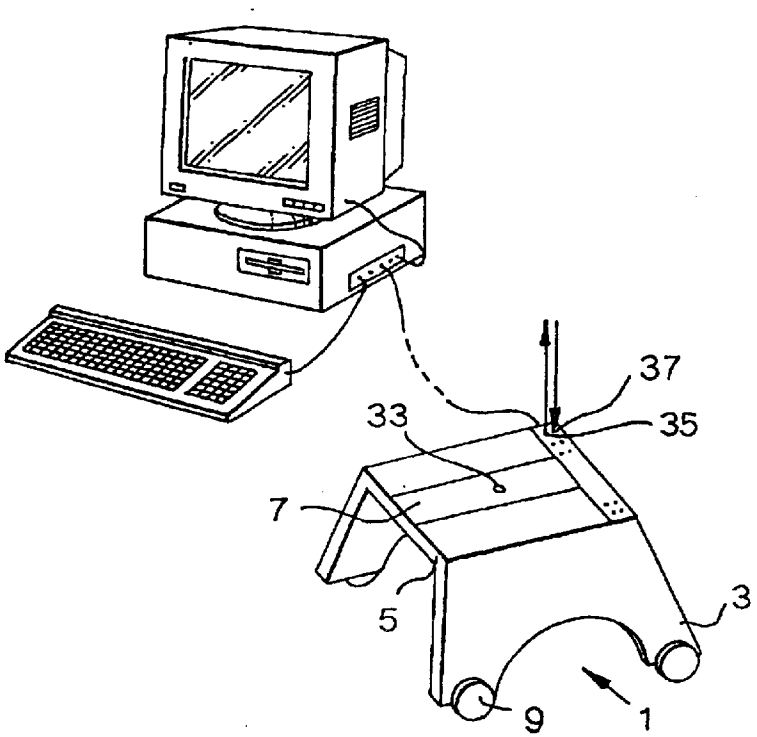

FIG. 7 shows a golf training apparatus in a further embodiment where like reference numerals are used for those features of the apparatus which are the same as in previous embodiments. In this embodiment, a simple net 43 is used to stop the golf ball 13. The direction that the golf ball takes after it has been struck is determined by using a line of LEDs 35 arranged at one end of the teeing apparatus 5 perpendicularly to the intended line of travel of the ball. Each LED emits a light beam. As the golf ball 13 passes through said light it will reflect (due to the ball's reflective surface) light beams back to a line of photodiodes 37 each one of which corresponds to one of the LEDs 35. A photodiode 33 is also provided on the artificial turf strip 7 and it is on this photodiode 33 that the ball 13 is placed prior to a shot being taken. When the golf ball 13 is struck the photodiode 33 is uncovered and this signals to a control unit such as a PC 41 to start measuring the outputs of each of the photodiodes 37. The output voltage $V_n$ (where n=diode number) of each of the photodiodes 37 is measured at discrete time intervals $T_1$ to $T_n$. The PC 41 then checks the profile of the diode output over time for each diode by calculating $V_nT_n-V_nT_{n-1}$ for each diode. When the ball is struck it will pass over one of the plurality of LEDs 35 and thereby reflect the light beam back onto the corresponding photodiode 37. For the purposes of illustration the diode over which the ball passes shall be given the reference M. $V_mT_n-V_mT_{n-1}$ will be greater than zero for this diode. If a diode n is not the diode over which the ball has passed, then the computer will check the output of the next diode n+1 and then calculate $V_{n+1}T_n-V_{n+1}T_{n-1}$ to check whether or not the signal is greater than zero. The PC 41 continues this process until the diode m where $V_mT_n-V_mT_{n-1}$ is greater than zero is found. The direction of the ball is thus determined, since the starting point is known and the point where the ball crosses the line of diodes is known. The computer may then display either a qualitative or a quantitative indication, either telling the golfer "Left", "Right" or "Straight", and optionally indicating the degree of deviation from a straight shot. The display may optionally also give instructions to the golfer to alter the, angle of the playing surface of the teeing apparatus 5.

In a further aspect, the adjustable teeing apparatus of the present invention can be used to assist a golfer in determining the correct lie angle for selecting his golf clubs.

The "lie angle" of a set of golf clubs is the acute angle which the club shaft makes with the plane of the sole of the club head, i.e. the angle between the club shaft and the ground when the golfer is addressing the ball. In such a position, the sole of the club should be 1 to 2 mm above ground level, at the toe end of the club (i.e. the end remote from the handle).

Golf clubs are manufactured in a number of different lie angles, so that clubs with standard shaft lengths can be used by golfers of different heights. Conventionally, clubs are manufactured with a "standard" lie angle and with lie angles of one and two degrees greater than or less than the "standard" angle. The "standard" angle is approximately 120 to 125 degrees. Shorter golfers will require clubs having a smaller lie angle, so that when the ball is addressed, the handle is not positioned too far from the ground for the golfer to grip satisfactorily. A taller golfer will require clubs with a larger lie angle, so that when the club head is correctly positioned relative to the ball, the handle of the shaft is higher above the ground.

To determine the correct lie angle for a particular golfer, a shortened club having a known shaft length and lie angle is given to the golfer, who is then asked to address a ball placed on the teeing surface at a predetermined height. By inspecting whether the sole of the club head lies parallel to the teeing surface and at the correct spacing, it can be ascertained whether the lie angle of the club is correct.

If the heel of the club head (that part of the club head nearest to the shaft connection or hosel) is spaced further from the teeing surface than the toe of the club head (that part of the club head furthest from the shaft connection or hosel), then the teeing surface can be raised so that the angle of the club changes to make the sole of the club parallel to the teeing surface. Conversely, if the heel of the club head is closer to the teeing surface than the toe of the club head, then the teeing surface can be lowered to make the sole of the club parallel to the teeing surface.

By providing a shortened golf club of a known length, when the shortened golf club is used by a golfer to address a ball and is positioned correctly relative to the teeing surface, the height of the teeing surface above the ground can give an indication of the correct lie angle for a full-sized club for this golfer.

According to this aspect, a method of determining the correct lie angle for golf clubs for a golfer comprises providing the golfer with a short golf club of known length, addressing a ball placed on a teeing surface, adjusting the height of the teeing surface until the head of the short golf club is correctly positioned relative to the teeing surface, and noting the height of the teeing surface above ground level. The correct lie angle for full-sized golf clubs for the golfer can then be determined by referring to a table correlating the height of the teeing surface above the ground with the correct lie angle. Alternatively, the height-adjusting mechanism of the teeing surface may be provided with graduated indicia relating either to the height of the teeing surface above ground level, or directly to the required lie angle for full-sized clubs.

An apparatus for use in the method for determining the correct lie angle for golf clubs for a golfer comprises a short golf club of a predetermined length, a height-adjustable teeing surface, means to determine the height of the teeing surface above ground level, and means to correlate the height of the teeing surface above ground level with the correct lie angle for full-sized clubs (clubs of a known, longer, shaft length) for the golfer.

An apparatus for use in the method for determining the correct lie angle for golf clubs for a golfer comprises a short golf club of a predetermined length, a height-adjustable teeing surface, means for determining the height of the teeing surface above ground level, and means to correlate the height of the teeing surface above ground level with the correct lie angle for full-sized clubs (clubs of a known, longer, shaft length) for the golfer.

In a further refinement of this aspect, the height of the teeing surface when the golfer addresses a ball with the shortened golf club can be used to determine not only the lie angle required for use with golf club shafts of a standard length, but can be used to provide a correlation between the required lie angle and the length of the shaft which the golfer wishes to use for his clubs. By measuring the height of the teeing surface when the golfer correctly addresses a ball using the shortened club of known length, an indication of the height above ground level of the golfer's hands is obtained. The golfer can then select the length of shaft he wishes to use, and a simple geometrical calculation will provide the correct lie angle. Alternatively, the golfer can select his required lie angle and a calculation can provide the correct shaft length for that golfer, based on the height above ground level of the golfer's hands when addressing the ball.

In a preferred arrangement, a table can be compiled wherein each value for the height of the teeing surface above the ground is associated with a plurality of shaft lengths and with a like number of lie angles, each lie angle being associated with a particular shaft length. When the correct height of the teeing surface has been ascertained, the golfer can simply consult the table to determine a desired combination of shaft length and lie angle to suit his requirements.

What is claimed is:

1. A method for training and correcting a golf swing, comprising:

placing a ball at a teeing point on a teeing surface which is tiltably adjustable about a horizontal tilt axis;

aligning a catch device with a target direction passing through the teeing point and extending perpendicularly to the tilt axis;

aiming along the target direction and executing a golf swing to strike the ball from the teeing point;

determining an actual direction of travel of the struck ball;

determining an azimuth difference between the target direction and the actual direction of travel of the struck ball; and varying the tilt angle of the teeing surface about the tilt axis based upon the azimuth difference between the target direction and the actual direction of travel of the struck ball.

2. The method of claim 1, wherein the step of determining the actual flight direction of travel of the struck ball comprises catching the ball in a compartment in the catch device.

3. The method of claim 2, wherein the catch device comprises a plurality of compartments arranged in a horizontal row, and wherein each compartment corresponds to a respective actual direction of travel of the ball from the teeing point to the catch device.

4. The method of claim 3, wherein the step of determining the actual flight direction of travel of the struck ball comprises catching the ball in a compartment in the catch device, and determining on which side of the target direction the compartment lies.

5. The method of claim 1, wherein the step of varying the tilt angle of the teeing surface about the tilt axis based upon the azimuth difference between the target direction and the actual direction of travel of the struck ball comprises tilting the teeing surface towards the catch device when it is determined that the actual direction of travel of the struck ball is on a side of the target direction towards the golfer.

6. The method of claim 1, wherein the step of varying the tilt angle of the teeing surface about the tilt axis based upon the azimuth difference between the target direction and the actual direction of travel of the struck ball comprises tilting the teeing surface away from the catch device when it is determined that the actual direction of travel of the struck ball is on a side of the target direction away from the golfer.

* * * * *